US006286606B1

(12) United States Patent
Krieg et al.

(10) Patent No.: US 6,286,606 B1
(45) Date of Patent: Sep. 11, 2001

(54) METHOD AND APPARATUS FOR CONTROLLING A WORK IMPLEMENT

(75) Inventors: Randy K. Krieg, Wasilla, AK (US); John J. Cheek, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/370,868

(22) Filed: Aug. 9, 1999

Related U.S. Application Data

(60) Provisional application No. 60/112,959, filed on Dec. 18, 1998.

(51) Int. Cl.[7] ..... E02F 3/76

(52) U.S. Cl. ..... 172/4.5; 172/779; 172/821; 172/812; 701/50

(58) Field of Search ..... 172/4.5, 2, 779, 172/818–821, 812; 701/50

(56) References Cited

U.S. PATENT DOCUMENTS

| | | | | |
|---|---|---|---|---|
| 4,136,508 | | 1/1979 | Coleman et al. . | |
| 4,185,700 | | 1/1980 | Atherton et al. | 172/796 |
| 4,221,266 | | 9/1980 | Fardal . | |
| 4,286,386 | | 9/1981 | Long . | |
| 4,288,196 | | 9/1981 | Sutton . | |
| 4,646,620 | | 3/1987 | Buchl . | |
| 4,733,310 | * | 3/1988 | Kapp et al. | 358/300 |
| 4,733,355 | | 3/1988 | Davidson et al. . | |
| 4,744,218 | | 5/1988 | Edwards et al. . | |
| 4,912,643 | | 3/1990 | Beirxe . | |
| 4,918,608 | | 4/1990 | Middleton et al. . | |
| 4,934,463 | | 6/1990 | Ishida et al. | 172/4.5 |
| 4,955,437 | | 9/1990 | Bohman . | |
| 5,065,326 | | 11/1991 | Sahm . | |
| 5,078,215 | | 1/1992 | Nau | 172/4.5 |
| 5,170,342 | | 12/1992 | Nakamura et al. . | |
| 5,274,557 | | 12/1993 | Moriya et al. . | |
| 5,327,345 | | 7/1994 | Nielsen et al. . | |
| 5,356,259 | | 10/1994 | Hanamoto et al. . | |
| 5,430,651 | | 7/1995 | Nielsen et al. . | |
| 5,499,684 | | 3/1996 | Stratton . | |
| 5,551,518 | | 9/1996 | Stratton . | |
| 5,631,658 | | 5/1997 | Gudat et al. . | |
| 5,647,439 | | 7/1997 | Burdick et al. . | |
| 5,667,020 | | 9/1997 | Palmer et al. | 172/781 |
| 5,735,352 | | 4/1998 | Henderson et al. . | |
| 5,894,894 | | 4/1999 | Szymczak . | |
| 5,905,986 | | 5/1999 | Rohrbaugh et al. . | |
| 5,947,225 | * | 9/1999 | Kawakami et al. | 180/271 |
| 5,951,612 | | 9/1999 | Sahm . | |
| 5,987,371 | | 11/1999 | Bailey et al. . | |

FOREIGN PATENT DOCUMENTS

| | | |
|---|---|---|
| 1390066 | 4/1975 | (GB) . |
| 57-071939 | 5/1982 | (JP) . |
| 58-164835 | 9/1983 | (JP) . |
| 59-102023 | 6/1984 | (JP) . |

* cited by examiner

*Primary Examiner*—Christopher J. Novosad
(74) *Attorney, Agent, or Firm*—Wood, Herron & Evans, LLP; John J. Cheek; Thomas L. Derry

(57) ABSTRACT

A method and apparatus for controlling a work implement movably connected to a work machine. An implement controller automatically controls simultaneous first and second control modes of operation assigned to the work implement. A sensor applies a signal to the implement controller indicating position of the work implement. The implement controller reverses the simultaneous first and second control modes assigned to the work implement upon detecting a predetermined movement of the work movement. The simultaneous first and second control mode assignments may also be changed by actuation of a manually actuatable device.

26 Claims, 4 Drawing Sheets

METHOD AND APPARATUS FOR CONTROLLING A WORK IMPLEMENT

This application claims the benefit of prior provision patent application Serial No. 60/112,959 filed Dec. 18, 1998.

TECHNICAL FIELD

The present invention relates generally to manual and automatic positioning of a work implement and, more particularly, to a method and apparatus for controlling modes of operation of a work implement of a work machine.

BACKGROUND ART

Work machines, such as motor graders, dozers, compactors, pavers, profilers and scrapers, are used for geographic surface altering operations. The machines include a work implement, such as a surface altering blade, that is movably connected to a frame of the machine by one or more hydraulic motors or cylinders, or the work implement may be fixed to the machine frame. The position of the blade relative to the work surface must be accurately controlled to achieve the desired surface altering cut.

In motor graders, for example, the surface altering blade is movably connected to the grader frame by a pair of independently actuatable hydraulic lift cylinders that are mounted on either side of the machine frame. The hydraulic lift cylinders are independently extensible and retractable to move corresponding sides of the blade relative to the machine frame. Each side of the blade may be set by the operator to operate in either a "manual" or "automatic" mode of operation. In either mode, each side of blade is also assignable by the operator to operate in a "grade sensor", "slope sensor" or "down force" mode of operation. Control for each side of the blade is independently assignable to one of the "grade sensor", "slope sensor" and "down force" modes of operation such that both sides may be assigned to "grade sensor" or "down force" modes, or one side assigned to "grade sensor" or "down force" mode while the other side is assigned to the "slope sensor" mode.

When "grade sensor" (or "down force") and "slope sensor" modes are assigned simultaneously to the opposite sides of the blade, the leading end or toe of the blade is generally assigned to the "grade sensor" mode, and the trailing or heel of the blade is assigned to the "slope sensor" mode. In "automatic" mode, a grade sensor maintains the grade sensor controlled side of the blade at a preselected position relative to a grade reference point. The elevation of the slope controlled side of the blade is controlled by a programmed cross slope value selected by the operator and stored in an implement controller that controls the "grade sensor", "down force" and "slope sensor" modes of operation.

During a grading operation in one direction, the operator rotates the blade to a desired grading angle relative to the machine frame and may assign the "grade sensor" (or "down force") and "slope sensor" control modes to the opposite sides of the blade. On a return grading pass in the opposite direction, the operator must rotate the blade to a mirror angle, and manually switch the "grade sensor" (or "down force") and "slope sensor" modes assigned to the opposite sides of the blade. To achieve the switch of the control modes, the operator must manually actuate control switches that are located in the cab.

During the motor grader reconfiguration process for the return grading pass, the operator may improperly reassign the control modes of operation to the blade which may result in the wrong cross slope cut. Moreover, the manual reconfiguration process required for grading in opposite directions reduces the operator's accuracy and efficiency.

The present invention is directed to overcoming one or more of the problems as set forth above.

DISCLOSURE OF THE INVENTION

The present invention overcomes the foregoing and other shortcomings and drawbacks of work implement positioning and methods heretofore known. While the invention will be described in connection with certain embodiments, it will be understood that the invention is not limited to these embodiments. On the contrary, the invention includes all alternatives, modifications and equivalents as may be included within the spirit and scope of the present invention.

In one aspect of the invention, an apparatus for controlling a work implement of a work machine in simultaneous first and second control modes of operation is provided. An implement controller is operable to assign the first and second control modes of operation to the work implement. Positioning mechanisms may be connected to each side of the work implement for altering the position of each side of the work implement.

One of the positioning mechanisms may be operable to move one side of the work implement to a first position, and the other positioning mechanism may be operable to move the other side of the work implement to a second position. A sensor is associated with the work implement and coupled to the implement controller for applying a signal to the implement controller indicating position of the work implement. The implement controller is operable to change the control mode assignments to the work implement upon determining a predetermined movement of the work implement as indicated by the sensor, such as a predetermined rotation of the work implement. Upon determining a predetermined movement of the work implement, the implement controller may be operable to reverse the first and second control mode assignments to the work implement, and may also be operable to reverse the first and second positions of the work implement as well.

In another aspect of the invention, a drive mechanism may be operatively connected to the work implement for moving the work implement between a first rotational position and a second rotational position under control of the implement controller. A manually actuatable device is electrically coupled to the implement controller. The implement controller is operable to reverse the control assignments to, and the rotational position of, the work implement upon actuation of the manually actuatable device.

In yet another aspect of the invention, a method for controlling a work implement of a work machine in simultaneous first and second control modes of operation is provided. First and second automatic control modes are assigned to the work implement. Movement of the work implement is sensed and, upon a predetermined movement of the work implement as detected during the sensing step, the first and second control modes assigned to the work implement are reversed.

BRIEF DESCRIPTION OF THE DRAWINGS

For better understanding of the present invention, reference may be made to the accompanying drawings in which.

BEST MODE FOR CARRYING OUT THE INVENTION

Figure 1:
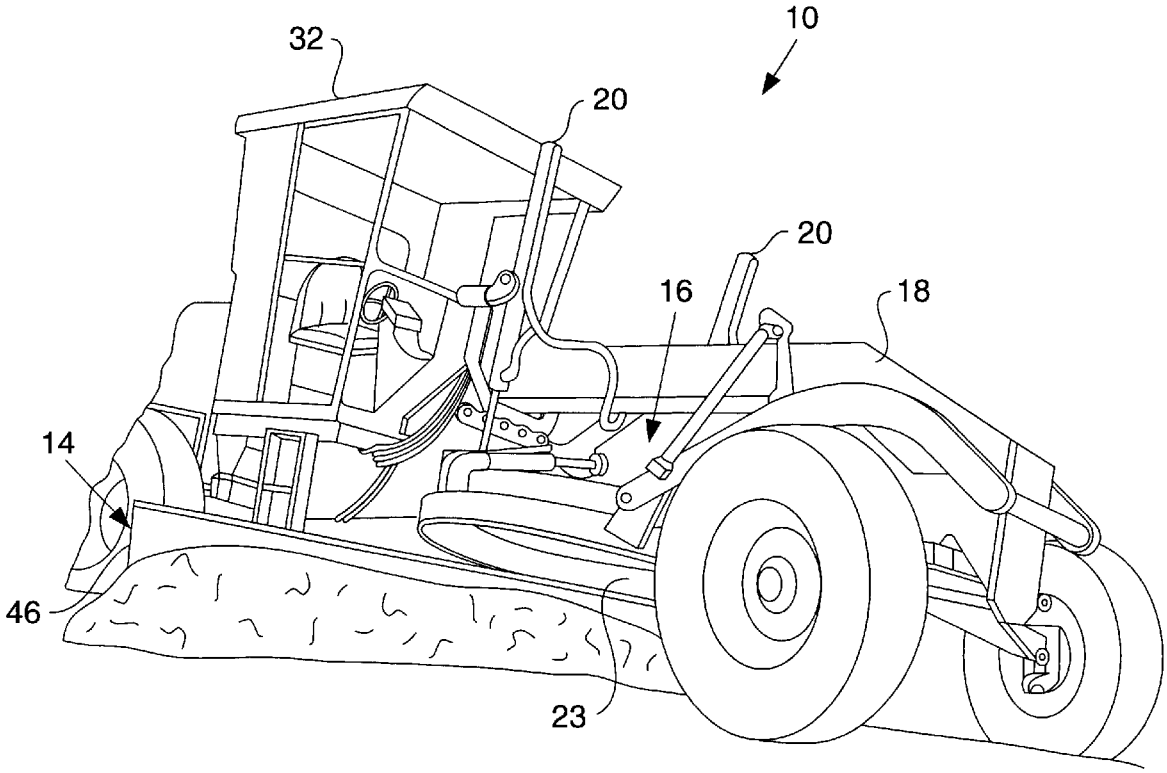
FIG. 1 is a partial perspective view of a motor grader including an implement control system for controlling control modes of a work implement.

With reference to the figures, and to FIG. 1 in particular, a work machine 10, illustrated as a geographic surface altering motor grader, is shown including an implement control system 12 (FIGS. 2A–2B) for controlling control modes of a work implement 14, illustrated as a conventional grader blade. The work implement 14 is part of a blade sub-assembly, indicated generally at 16, that is movably mounted to a frame 18 of the motor grader 10 through a pair of selectively actuatable hydraulic motors or lift cylinders 20 that are connected between the machine frame 18 and the blade sub-assembly 16. The blade sub-assembly 16 includes a circle draw bar, indicated generally at 22, a circle 23 (FIGS. 2A and 2B) rotatably mounted to the circle draw bar 22, and grader blade 14 mounted to the circle 23. A selectively actuatable circle drive 24 (FIGS. 2A and 2B) is mounted to the circle draw bar 22 for rotating the circle 23 and the blade 14 mounted thereto about an elevational axis 25 (FIG. 3) located at the center of the circle 23 in a known manner. While the implement control system 12 will be described in detail below as applied to a motor grader, it will be appreciated by those skilled in the art that other geographic surface altering machines, such as dozers, compactors, pavers, profilers, scrapers and the like, equipped with suitable surface altering implements, are equivalents and considered within the scope of the invention.

Figure 2A:
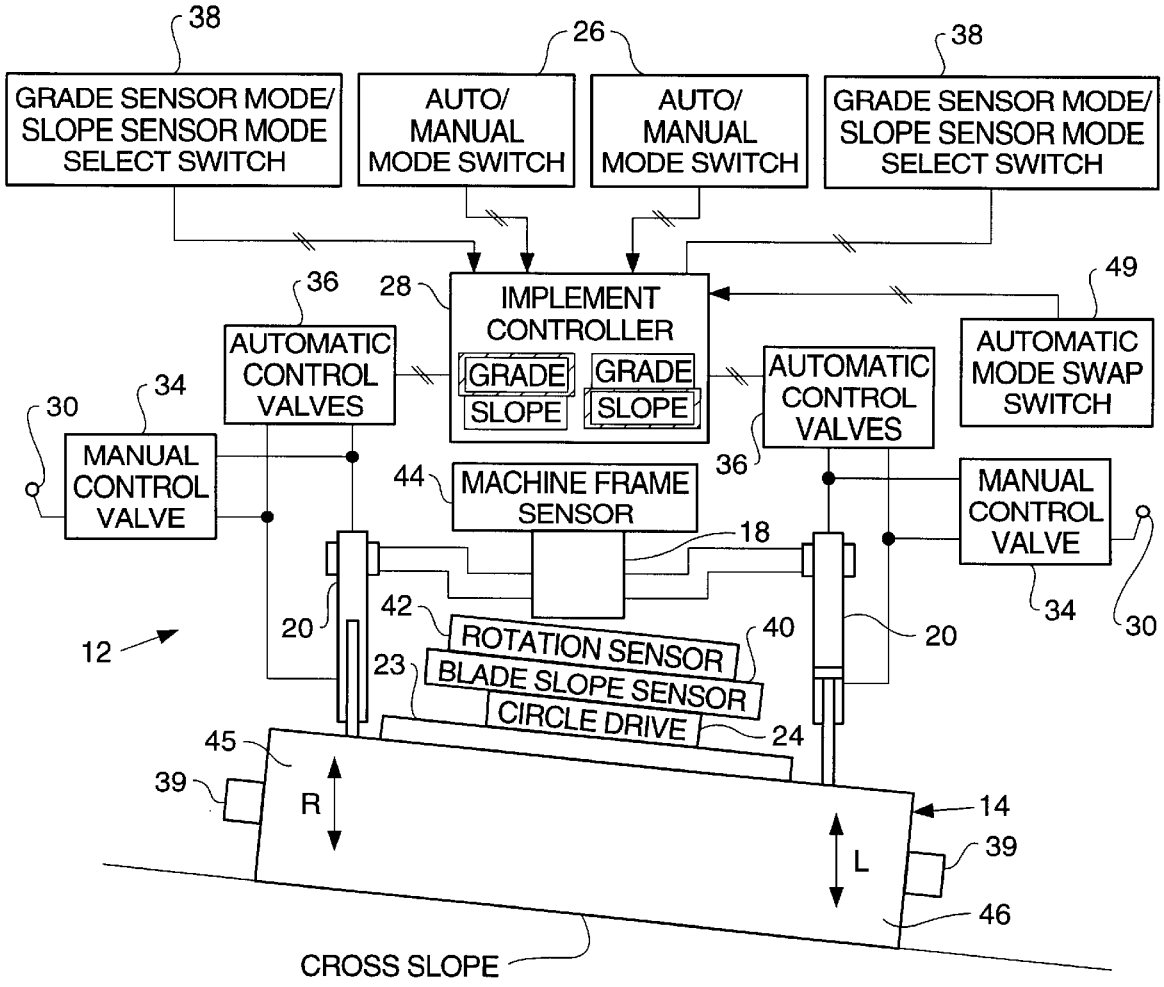
FIGS. 2A and 2B are diagrams, partly schematic and partly block, showing front views of the motor grader of FIG. 1 traveling in opposite grading directions, and an implement control system for controlling control modes of a work implement as applied to a grader blade of the motor grader shown in FIG. 1.
Figure 2B:
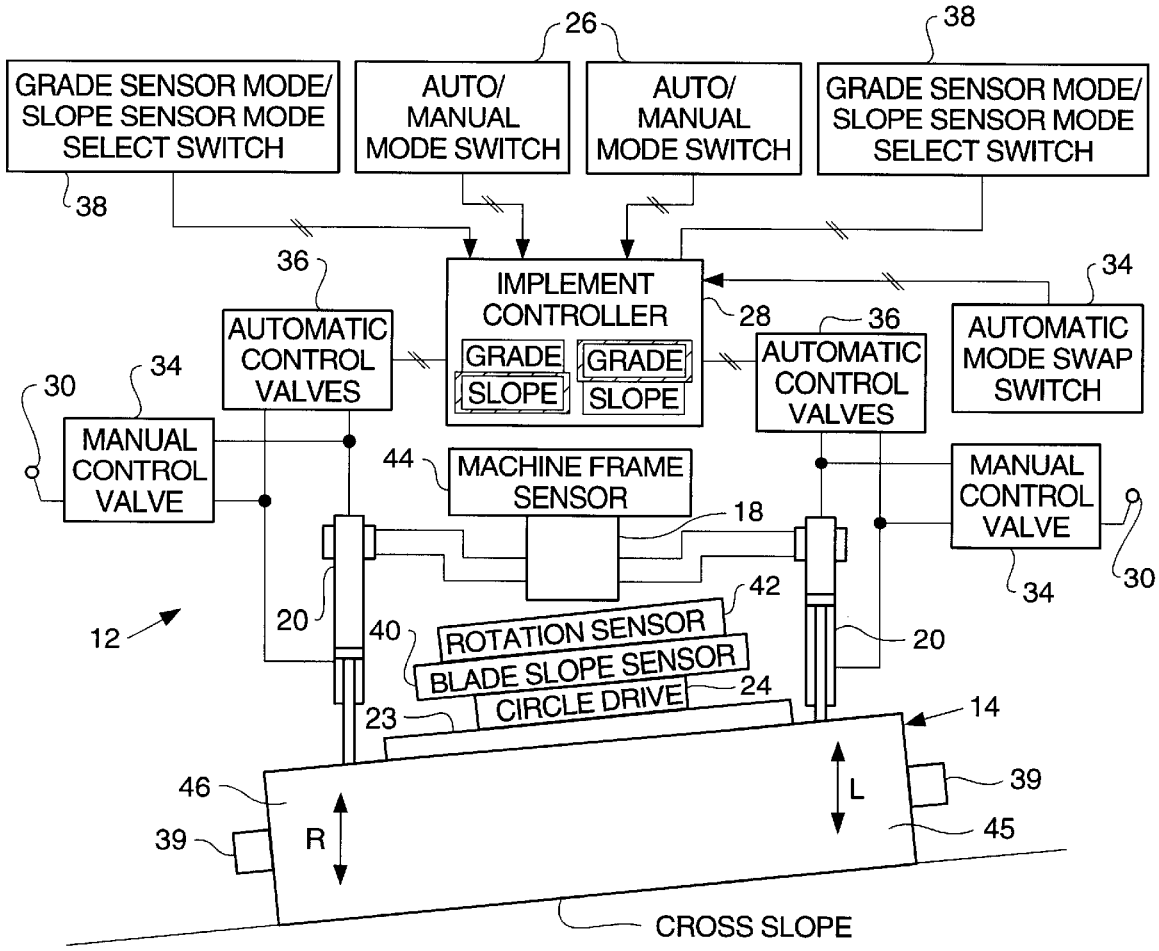

With reference to FIGS. 2A and 2B, the implement control system 12 is shown applied to motor grader 10 and, in particular, to the grader blade 14. During operation of the motor grader 10, the grade and cross-slope positions of blade 14 may be controlled by manual and/or automatic extension and retraction of the hydraulic lift cylinders 20 connected to the blade sub-assembly 16. The pair of hydraulic lift cylinders 20 are extensibly movable to elevationally move corresponding sides of the blade 14 relative to the frame 18.

Each side of the blade 14 may be manually set by the operator to operate in either "manual" or "automatic" control modes of operation through a pair of mode select switches 26 that are each dedicated to a corresponding side of blade 14. Control for each side of the blade 14 is independently assignable to one of the "manual" and "automatic" control modes of operation such that both sides may be assigned to "manual" mode, one side may be assigned to "manual" mode while the other side is assigned to "automatic" mode, or both sides may be assigned to "automatic" mode. The mode select switches 26 are electrically coupled to an implement controller 28 that is responsible for controlling the side of blade 14 that is assigned to the "automatic" mode of operation as described in greater detail below. Implement controller 28 includes a processor (not shown) of any suitable kind, such as a microprocessor having appropriate control software and memory (not shown) to store the selected "manual" and "automatic" control modes of operation for each side of blade 14.

In the "manual" control mode, the operator controls the elevational position of one or both sides of the blade 14 through a pair of implement positioning devices, such as a pair of manually actuatable control levers 30, that are located within a cab 32 (FIG. 1) of the motor grader 10. Each of the manually actuatable control levers 30 is connected to a manually actuatable or manual control valve 34. The pair of manual control valves 34 are each connected between a hydraulic fluid supply (not shown), and a corresponding one of the hydraulic lift cylinders 20 mounted on a respective side of machine frame 18. Movement of each control lever 30 in one direction allows hydraulic fluid to flow under pressure through the manual control valves 34 to actuate the hydraulic lift cylinders 20 to an extended or retracted position. Movement of each control lever 30 in the opposite direction causes a reverse directional movement of the hydraulic lift cylinders 20. In a neutral position of control levers 30, the manual control valves 34 assume a neutral or dead position that inhibits hydraulic fluid flow through the manual control valves 34.

Further referring to FIGS. 2A and 2B, a pair of electrically actuatable or automatic control valves 36 are connected between the hydraulic fluid supply (not shown) and a corresponding one of the hydraulic lift cylinders 20 to control extension and retraction of the corresponding hydraulic lift cylinder 20 in the "automatic" control mode. The automatic control valves 36 are electrically coupled to the implement controller 28 for receiving command signals from the implement controller 28 to adjust the elevational position of a corresponding blade side through actuation of a respective hydraulic lift cylinder 20. The automatic control valves 36 are connected in parallel with the manual control valves 34, and are operable independently from the manual control valves 34 as described in detail below.

In the "automatic" control mode, for example, each side of blade 14 may be assigned by the operator to a "grade sensor" mode or a "slope sensor" mode through a pair of sensor select switches 38 that are each dedicated to a corresponding side of blade 14. Other sensor modes are possible as well. For example, while not shown, each side of blade 14 is assignable to a "down force" mode of operation. Control for each side of blade 14 is independently assignable to one of the "grade sensor", "down force" and "slope sensor" modes of operation such that both sides may be assigned to "grade sensor" mode, both sides may be assigned to "down force" mode, or one side may be assigned to "grade sensor" or "down force" mode while the other side is assigned to the "slope sensor" mode. The assigned sensor modes for each side of blade 14 are stored in memory (not shown) of the implement controller 28. For simplicity of discussion, only the "grade sensor" and "slope sensor" modes of operation will be described hereinafter in the automatic operation of motor grader 10. However, it will be appreciated that the "grade sensor", "down force" and "slope sensor" modes of operation may also be assigned to corresponding sides of blade 14 in the "manual" control mode as well.

In "grade sensor" mode, an ultrasonic sensor or a laser sensor, both indicated generally at 39, (FIGS. 2A and 2B), may be used to control the elevational position of the respective blade side relative to a grade reference point, such as a finished surface, curb, gutter, stringline or laser reference beam. The ultrasonic sensors or laser sensors 39 are coupled to the implement controller 28, and provide signals to the implement controller 28 indicating the elevational position of the corresponding side of blade 14.

In "grade sensor" mode, the grade sensor controlled side of blade 14 is maintained generally at a preselected elevational position or grade by the implement controller 28 that continuously compares the actual elevational position as determined by the grade sensor (not shown) with a desired grade setting selected by the operator. The implement controller 28 makes compensating elevational adjustments of the grade controlled side of the blade 14 through actuation of the corresponding hydraulic lift cylinder 20 as required. The operator selected "grade sensor" mode elevational value (or pair of values if both blade sides are assigned to the "grade sensor" mode) is assigned to the implement controller 28 through a corresponding one (or both) of a pair of momentary rocker switches (not shown) that are electrically coupled to the implement controller 28.

A two-axis blade slope sensor, indicated generally at 40 (FIGS. 2A and 2B) is mounted on the blade sub-assembly 16 to provide blade pitch and blade roll signals to the implement controller 28 through electrical leads (not shown). In the "automatic" control mode, each side of the blade 14 may alternatively be assigned to a "slope sensor" mode in which the grade sensor controlled side of the blade 14 is maintained at the preselected elevational position as described above, while the implement controller 28 controls the cross slope of the "slope sensor" controlled blade side according to a kinematic control algorithm performed by the implement controller 28. As used herein, "cross slope" is the slope of a cut made by the blade 14 perpendicular to the direction of machine travel. The implement controller 28 receives the blade pitch and blade roll signals from the two-axis blade slope sensor 40, as well as signals from a blade rotation sensor 42 indicating blade rotation, and machine frame pitch and machine frame roll from a two-axis machine frame sensor 44 mounted to machine frame 18. Each of these values is taken into account by the kinematic control algorithm to accurately control the cross slope of the slope controlled side of the blade 14.

In "slope sensor" mode, the slope sensor controlled side of the blade 14 is maintained generally at a preselected elevational position as defined by the elevational position of the grade controlled side of blade 14 and the operator selected cross slope value. The implement controller 28 continuously compares the actual cross slope value computed from the various sensor signals with the desired cross slope, and makes compensating elevational adjustments through actuation of the corresponding hydraulic lift cylinder 20 as required. The operator selected "slope sensor" mode elevational value, i.e, cross slope value, is assigned to the implement controller 28 through a touch pad set point capture button. The cross slope value can be modified by a corresponding one of the pair of momentary rocker switches (not shown) electrically coupled to the implement controller 28.

Figure 3:
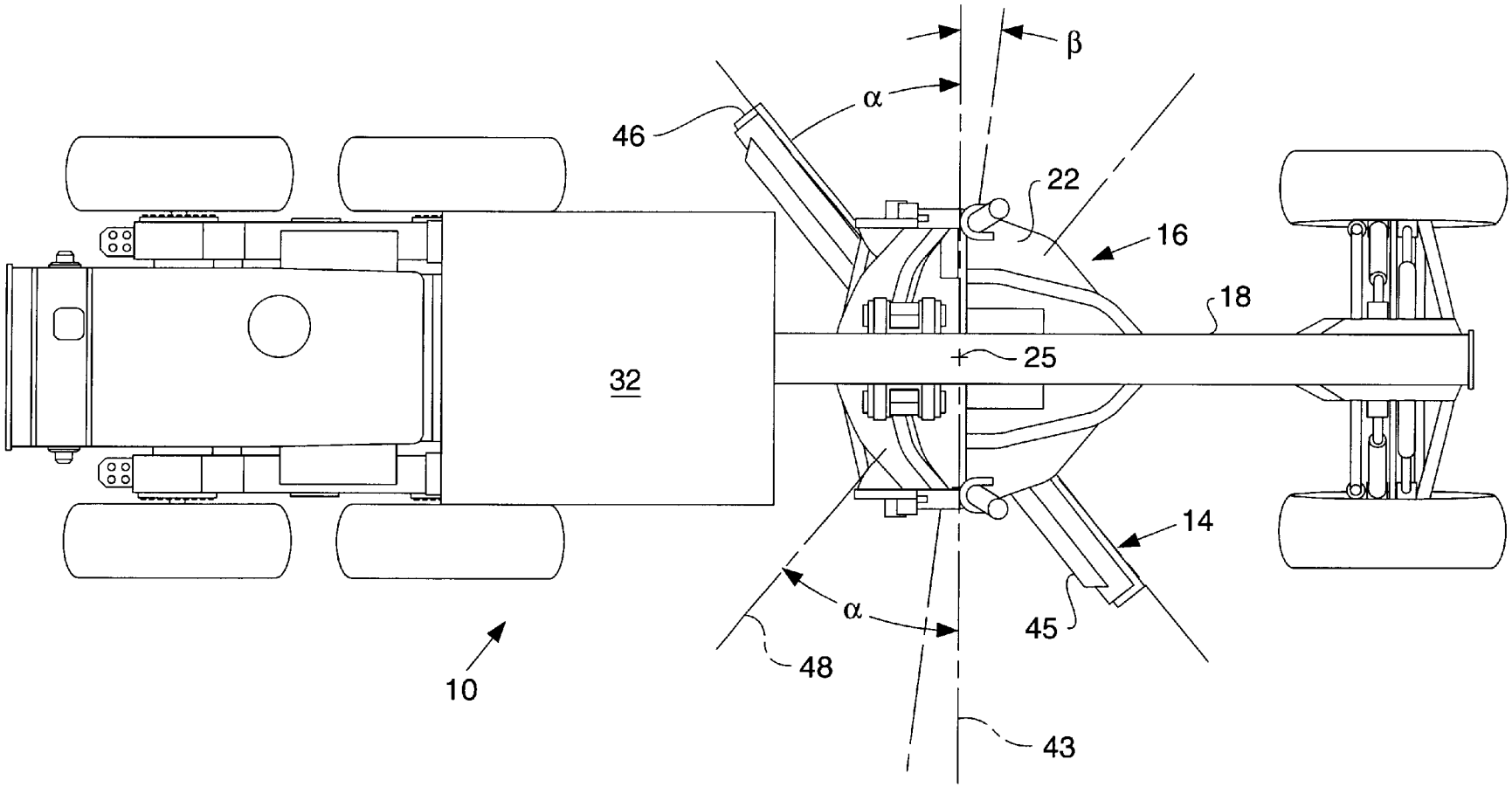
FIG. 3 is a top plan view of the motor grader shown in FIG. 1.

During a grading operation, as shown in FIGS. 1 and 3, the operator rotates the blade 14 to a desired grading angle relative to machine frame 18 through actuation of circle drive 24. Typically, most grading operations are performed with the blade 14 rotated clockwise or counterclockwise at an angle " " between about 10° and about 45° relative to an axis 43 transverse to machine frame 18. As the motor grader 10 grades in opposite passes (or directions) as shown in FIGS. 2A and 2B, both sides of blade 14 may be assigned to the "automatic" control mode of operation, with one or both sides of blade 14 assigned to "grade sensor" (or "down force") mode, or one side assigned to "grade sensor" (or "down force") mode and the other side assigned to "slope sensor" mode. When "grade sensor" and "slope sensor" modes are assigned simultaneously to the opposite sides of blade 14 as shown in FIGS. 2A and 2B, the leading end or toe 45 of blade 14 is typically assigned to the "grade sensor" mode, and the trailing end or heel 46 of blade 14 is assigned to the "slope sensor" mode. When the operator changes directions to grade in the opposite direction, the blade 14 is rotated to a mirror angular position, as indicated generally at 48.

In one aspect of the present invention, the rotational position of blade 14 relative to machine frame 18 is provided by blade rotation sensor 42 (FIGS. 2A and 2B) to the implement controller 28 as a pulse width modulation (PWM) signal. The implement controller 28 converts the PWM signal from blade rotation sensor 42 to a rotational position value and determines if blade 14 has been rotated through a preselected angle " ", referred to hereafter as the "swap position". Blade rotation sensor 42 may include potentiometers (not shown), limit switches (not shown), electromechanical actuators (not shown), encoders (not shown), or equivalent sensors associated with circle 23 and blade 14 for providing signals to implement controller 28 that indicate the rotational position of blade 14 relative to a fixed reference point. Alternatively, the blade rotation signal applied to implement controller 28 may be generated by sensors (not shown) located in the environment of motor grader 10 that are operable to detect a rotated position of blade 14.

As shown in FIG. 2A, in one grading pass of motor grader 10, the right side or toe 45 of blade 14 (as viewed from within cab 32) is assigned to the "grade sensor" mode of operation, and is elevated in position relative to the left side or heel 46 of blade 14. The grade sensor 39 maintains the toe 45 of blade 14 at a preselected elevational position relative to a grade reference point through control of the corresponding hydraulic lift cylinder 20 by implement controller 28. The heel 46 is assigned to the "slope sensor" mode of operation, and its elevation is controlled by the programmed cross slope value selected and stored in the implement controller 28 that controls the corresponding hydraulic lift cylinder 20.

With reference to FIGS. 2A, 2B and 3, as the operator rotates the blade 14 through the "swap position" as determined by implement controller 28, the implement controller 28 automatically changes the "grade sensor" and "slope sensor" assignments to the toe 45 and heel 46 of blade 14, and the cross slope of the blade 14. Preferably, implement controller 28 automatically reverses or "swaps" the "grade sensor" and "slope sensor" assignments to the toe 45 and heel 46 of blade 14, and the cross slope of the blade 14 to configure motor grader 10 to grade in the opposite direction as shown in FIG. 2B. During the "automatic" swap, the sides of blade 14 may each be assigned to the "manual" mode of operation to prevent any unexpected movement of blade 14 during the "swap".

Alternatively, an automatic mode swap switch 49 (FIGS. 2A and 2B) may be provided in cab 32 to allow the operator to automatically rotate the blade 14 to the mirror angular position 48 (FIG. 3) by a single manual actuation of the switch 49. Depression of the automatic mode swap switch 49 also automatically changes the "grade sensor" and "slope sensor" assignments to the toe 45 and heel 46 of blade 14, and the cross slope of blade 14 as described in detail above. In this aspect of the invention, the automatic mode swap switch 49 is electrically coupled to the implement controller 28. The circle drive 24 is an electrohydraulic circle drive that operates under the control of implement controller 28. The set rotational position of blade 14 during a beginning grading pass is stored in memory of the implement controller 28, and is recalled by implement controller 28 to automatically move blade 14 to the mirror angular position 48 upon depression of switch 49 to reconfigure the motor grader 10 for a return grading pass in the opposite direction.

Industrial Applicability

With reference to the drawings and in operation, the operator of the work machine 10 selects "manual" or "automatic" modes of operation for each side of the blade 14 by actuating the mode select switches 26 corresponding to each side of the blade 14. In either mode, the operator also selects "grade sensor", "down force", or "slope sensor" control for each side of the blade 14 by actuating sensor select switches 38 corresponding to each side of the blade 14. Control of each side of blade 14 is independently assignable to one of the "manual" and automatic" modes of operation, and one of the "grade sensor", "down force" and "slope sensor" modes as well.

After a grading pass in one direction, the operator rotates blade 14 relative to frame 18 to configure the rotation of blade 14 for the return pass in the opposite direction. As the blade 14 rotates past the predetermined "swap position", the implement controller 28 preferably automatically reverses or "swaps" the "grade sensor" (or "down force") and "slope sensor" assignments to the toe 45 and heel 46 of blade 14, and the cross slope of the blade 14 to configure motor grader 10 to grade in the opposite direction.

Alternatively, the operator manually actuates the automatic mode swap switch 49 to automatically rotate blade 14 to the mirror angular position 48, and preferably reverse the "grade sensor" (or "down force") and "slope sensor" assignments to corresponding sides of the blade 14, and the cross slope of blade 14.

The automatic "swap" performed by implement controller 28 enhances operator accuracy and efficiency as the blade 14 is automatically configured for grading in the opposite direction.

Other aspects, objects and advantages of the present invention can be obtained from a study of the drawings, the disclosure and the appended claims.

What is claimed is:

1. An apparatus for controlling a work implement of a work machine in simultaneous first and second control modes of operation, comprising:

an implement controller operable to assign the first and second control modes of operation to the work implement wherein the implement controller is operable to reverse the first and second mode assignments to the work implement upon receipt of a signal; and a sensor associated with the work implement and coupled to the implement controller for applying said signal to the implement controller indicating position of the work implement, whereby the implement controller is operable to change the control mode assignments to the work implement upon determining a predetermined movement of the work implement as indicated by the sensor.

2. An apparatus as recited in claim 1, wherein the implement controller is operable to detect a predetermined rotation of the work implement.

3. An apparatus as recited in claim 1, including a manually actuatable device coupled to the implement controller for selecting the first and second control mode assignments to the work implement.

4. An apparatus as recited in claim 1, including a sensor associated with the work implement and coupled to the implement controller for applying signals to the implement controller indicating pitch and roll positions of the work implement.

5. A geographic surface altering work machine, comprising:

a moveable machine frame;

a work implement moveably connected to the machine frame; and an apparatus for controlling the work implement in simultaneous first and second control modes of operation according to claim 1.

6. An apparatus for controlling opposite sides of a work implement of a work machine in simultaneous first and second control modes of operation, comprising:

an implement controller operable to assign the first and second control modes of operation to the opposites sides of the work implement, wherein one side of the work implement is assigned to the first control mode and the other side of the work implement is assigned to the second control mode; and a sensor associated with the work implement and coupled to the implement controller for applying a signal to the implement controller indicating position of the work implement, whereby the implement controller is operable to change the first and second control mode assignments to the opposite sides of the work implement upon determining a predetermined movement of the work implement as indicated by the sensor.

7. An apparatus as recited in claim 6, wherein the implement controller is operable to detect a predetermined rotation of the work implement.

8. An apparatus as recited in claim 6, wherein the implement controller is operable to reverse the first and second control mode assignments to the opposite sides of the work implement upon receipt of the signal from the sensor.

9. An apparatus as recited in claim 6, including a manually actuatable device coupled to the implement controller for selecting the first and second control mode assignments to the opposite sides of the work implement.

10. An apparatus as recited in claim 6, including a sensor associated with each side of the work implement and coupled to the implement controller, wherein each sensor is operable to apply a signal to the implement controller indicating elevational position of the corresponding side of the work implement.

11. An apparatus as recited in claim 6, including a sensor associated with the work implement and coupled to the implement controller for applying a signal to the implement controller indicating slope of the work implement.

12. An apparatus for controlling opposite sides of a work implement of a work machine in simultaneous first and second modes of operation, comprising:

an implement controller operable to assign the first and second control modes of operation to the opposites sides of the work implement, wherein one side of the work implement is assigned to the first control mode and the other side of the work implement is assigned to the second control mode;

positioning mechanisms connected to each side of the work implement for altering the position of each side of the work implement, wherein one of the positioning mechanisms is operable to move one side of the work implement to a first position and the other positioning mechanism is operable to move the other side of the work implement to a second position; and a sensor associated with the work implement and coupled to the implement controller for applying a signal to the implement controller indicating position of the work implement, whereby the implement controller is operable to change the control mode assignments to, and the first and second positions of, the opposite sides of the work implement upon determining a predetermined movement of the work implement as indicated by the sensor.

13. An apparatus as recited in claim 12, wherein the implement controller is operable to reverse the first and second control mode assignments to the opposite sides of the work implement upon receipt of the signal from the sensor.

14. An apparatus as recited in claim 12, wherein the implement controller is operable to reverse the first and second positions of the opposite sides of the work implement upon receipt of the signal from the sensor.

15. An apparatus as recited in claim 12, including a sensor associated with each side of the work implement and coupled to the implement controller, wherein each sensor is operable to apply a signal to the implement controller indicating elevational position of the corresponding side of the work implement.

16. An apparatus as recited in claim 12, including a sensor associated with the work implement and coupled to the implement controller for applying a signal to the implement controller indicating slope of the work implement.

17. An apparatus for controlling a work implement of a work machine in simultaneous first and second control modes of operation, comprising:

an implement controller operable to assign the first and second control modes of operation to the work implement;

a drive mechanism operatively connected to the implement controller and the work implement for moving the work implement between a first rotational position and a second rotational position under control of the implement controller; and a manually actuatable device electrically coupled to the implement controller, whereby the implement controller is operable to change the control mode assignments to, and the position of, the work implement upon actuation of the manually actuatable device.

18. An apparatus as recited in claim 17, wherein the implement controller is operable to reverse the first and second control mode assignments to the work implement upon actuation of the manually actuatable device.

19. An apparatus as recited in claim 17, wherein the implement controller is operable to reverse the first and second rotational positions of the work implement upon actuation of the manually actuatable device.

20. A geographic surface altering work machine, comprising:

a moveable machine frame;

a work implement moveably connected to the machine frame; and an apparatus for controlling the work implement in simultaneous first and second control modes of operation according to claim 17.

21. A method for controlling a work implement of a work machine in simultaneous first and second control modes of operation, comprising:

as signing a first control mode to the work implement;

assigning a second control mode to the work implement;

sensing movement of the work implement;

and reversing the first and second control modes assigned to the work implement upon a predetermined movement of the work implement as detected during the sensing step.

22. A method as recited in claim 21, wherein the sensing step includes sensing rotational movement of the work implement.

23. A method for controlling a work implement of a work machine in simultaneous first and second control modes of operation, comprising:

assigning a first control mode to the work implement;

assigning a second control mode to the work implement;

detecting actuation of a manually actuatable device; and reversing the first and second control modes assigned to the work implement upon actuation of the manually actuatable device as detected during the detecting step.

24. A method for controlling opposite sides of a work implement of a work machine in simultaneous first and second control modes of operation, comprising:

assigning a first control mode to one side of the work implement;

assigning a second control mode to the other side of the work implement;

sensing movement of the work implement;

and reversing the first and second control modes assigned to the work implement upon a predetermined movement of the work implement as detected during the sensing step.

25. A method as recited in claim 24, wherein the sensing step includes sensing rotational movement of the work implement.

26. A method as recited in claim 24, including the steps of:

positioning one of the sides of the work implement at a first position;

positioning the other side of the work implement at a second position; and reversing the first and second positions of the work implement upon a predetermined movement of the work implement as detected during the sensing step.

* * * * *